US007451717B1

(12) United States Patent
Levine et al.

(10) Patent No.: US 7,451,717 B1
(45) Date of Patent: Nov. 18, 2008

(54) SYSTEMS AND PROCESSES FOR COVERING OPENINGS OF MARINE VESSEL HULLS

(75) Inventors: Robert A. Levine, Houston, TX (US); A. Stefan Bern, Katy, TX (US); Joseph P. Madden, Long Beach, CA (US); Christopher T. Chipuk, College Station, TX (US)

(73) Assignee: ConocoPhillips Company

( * ) Notice: Subject to any disclaimer, the term of this patent is extended or adjusted under 35 U.S.C. 154(b) by 0 days.

(21) Appl. No.: 10/851,490

(22) Filed: May 21, 2004

(51) Int. Cl.
*B63B 43/16* (2006.01)
*B63B 19/14* (2006.01)
*B63B 19/18* (2006.01)
*B63B 13/02* (2006.01)

(52) U.S. Cl. ..... 114/227; 114/174; 114/201 R; 114/202; 114/229

(58) Field of Classification Search .. 114/201 R–201 A, 114/202, 203, 227–229, 173, 174, 125; 105/282.1; 29/402.09, 402.14
See application file for complete search history.

(56) References Cited

U.S. PATENT DOCUMENTS 1,253,293 A * 1/1918 Sons ..... 114/228
1,275,376 A * 8/1918 Brown ..... 105/255
1,862,236 A * 6/1932 Neville et al. ..... 114/177
2,127,871 A * 8/1938 Kozloff ..... 114/227
3,329,121 A * 7/1967 Ulrich et al. ..... 114/227
3,613,640 A 10/1971 Cohen
3,731,264 A 5/1973 Campbell et al.
3,745,957 A * 7/1973 Hendrickson et al. ..... 114/202
3,918,380 A * 11/1975 Graham et al. ..... 114/264
4,175,510 A * 11/1979 Devine ..... 114/227
4,455,186 A * 6/1984 Koehmstedt ..... 156/273.9
4,833,829 A * 5/1989 Wilson ..... 49/426
4,953,491 A * 9/1990 Zaitoun ..... 114/229
5,025,972 A * 6/1991 Finlan ..... 228/32
5,036,786 A * 8/1991 Uri ..... 114/229
5,165,356 A * 11/1992 Williams ..... 114/229
5,216,973 A * 6/1993 Gwinn ..... 114/229
5,450,807 A 9/1995 Moody (Continued)

FOREIGN PATENT DOCUMENTS

AT 411748 B * 4/2004

(Continued)

OTHER PUBLICATIONS

English translation of AT 411748 B.*

(Continued)

*Primary Examiner*—Ajay Vasudeva

(57) ABSTRACT

Systems and processes for closing openings in marine vessel hulls are provided. The systems and processes facilitate repairs and maintenance of marine vessels by closing openings in the marine vessel hulls to permit dry access to compartments in communication with the openings. The processes and systems incorporate a cover constructed from a lightweight material such as fiberglass, a viscoelastic material such as polyethylene or polyurethane, and blends thereof. The cover is guided in place to effectuate closure of the opening by a track device that receives at least two of the peripheral edges of the cover and directs the cover to the proper position to close the hull opening. The cover may be lowered into place by use of a hoisting device such as a davit.

14 Claims, 5 Drawing Sheets

U.S. PATENT DOCUMENTS

| | | | | |
|---|---|---|---|---|
| 5,692,451 | A | 12/1997 | Pastore | |
| 5,758,992 | A * | 6/1998 | Sawallisch | 406/151 |
| 6,135,041 | A | 10/2000 | Hamata | |
| 6,503,022 | B1 * | 1/2003 | Nuss | 405/195.1 |
| 6,557,480 | B1 * | 5/2003 | Nuss | 114/173 |
| 2004/0011265 | A1 | 1/2004 | Pastore | |

FOREIGN PATENT DOCUMENTS

| | | | | |
|---|---|---|---|---|
| GB | 0518913 | A * | 3/1940 | 114/227 |
| GB | 1202988 | B1 | 8/1970 | |
| GB | 2206917 | A * | 1/1989 | |
| JP | 61132495 | A * | 6/1986 | |

OTHER PUBLICATIONS

International Search Report dated Oct. 10, 2005 in PCT/US2005/017580.

* cited by examiner

FIG. 3
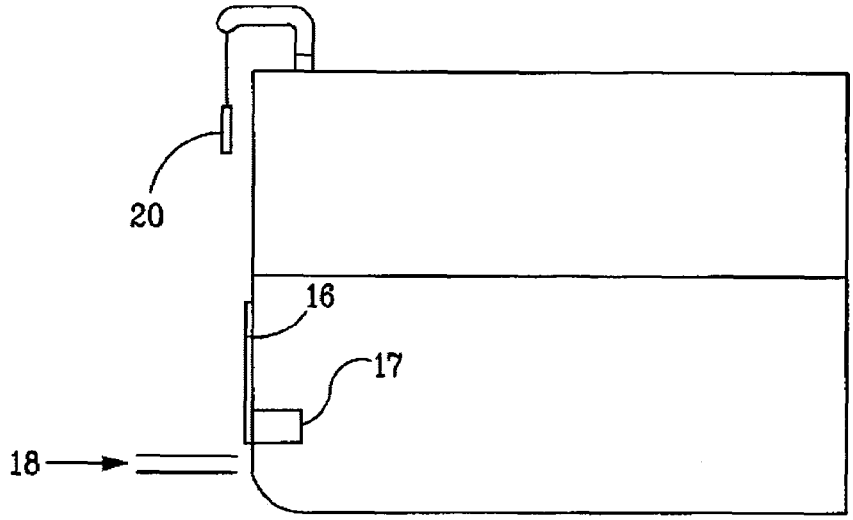
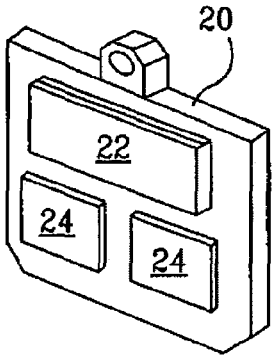
FIG. 4
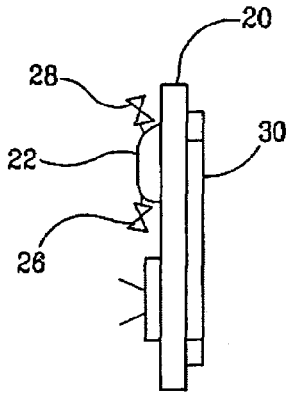
FIG. 5
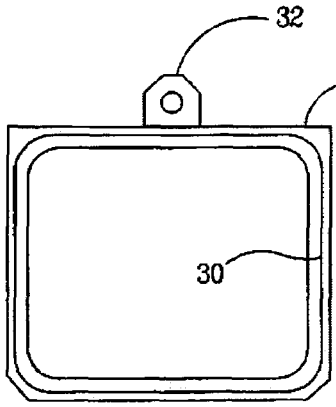
FIG. 6

FIG. 7
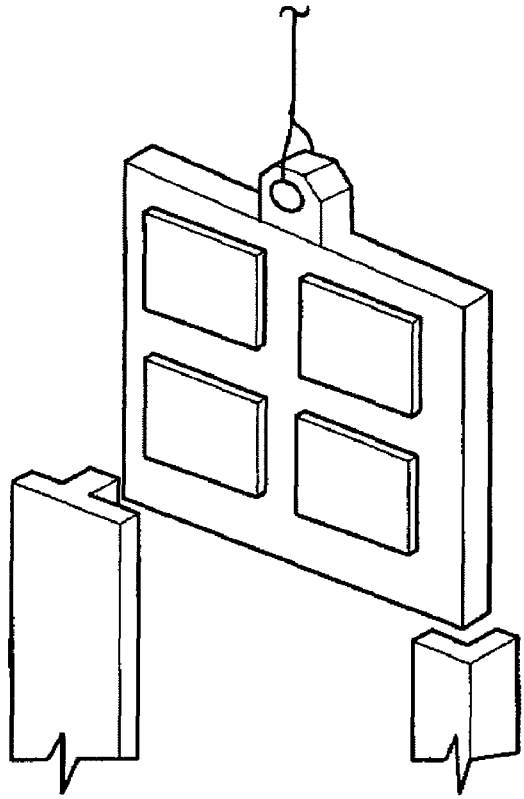
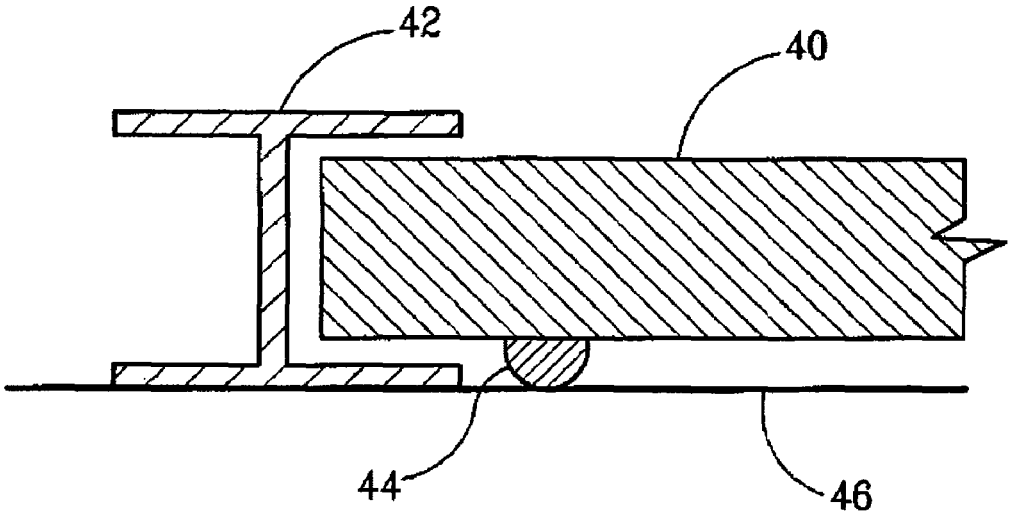
FIG. 8

FIG. 9A
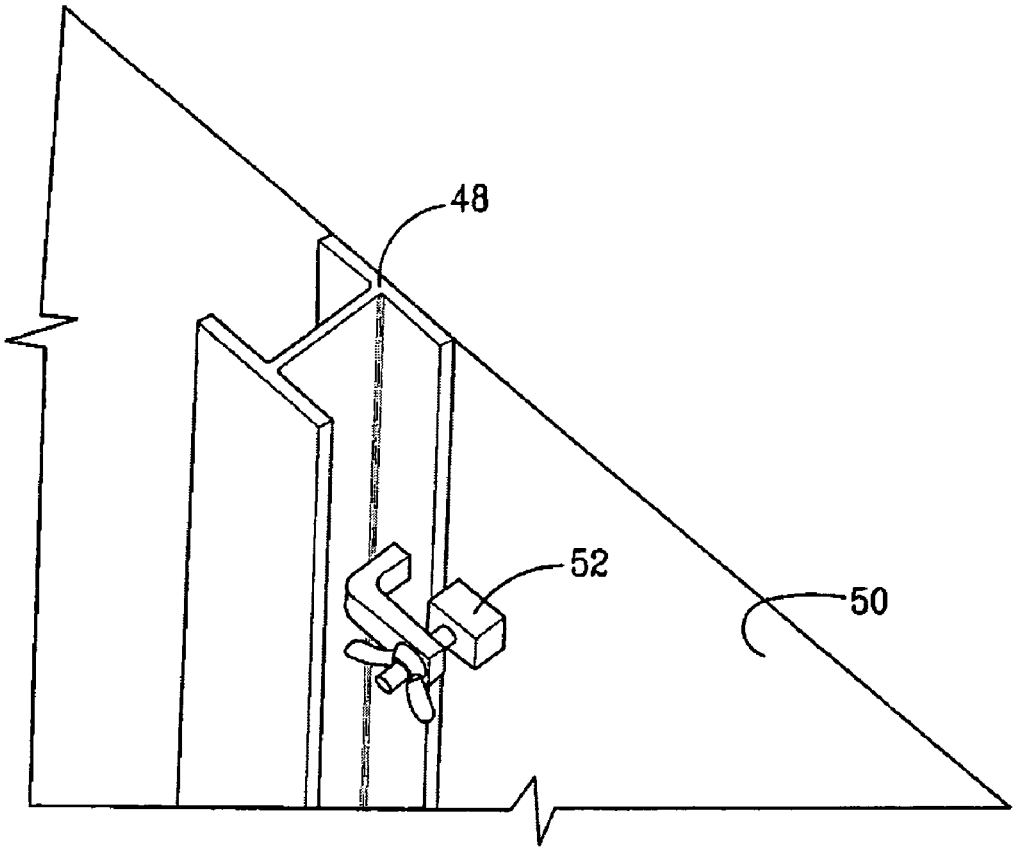
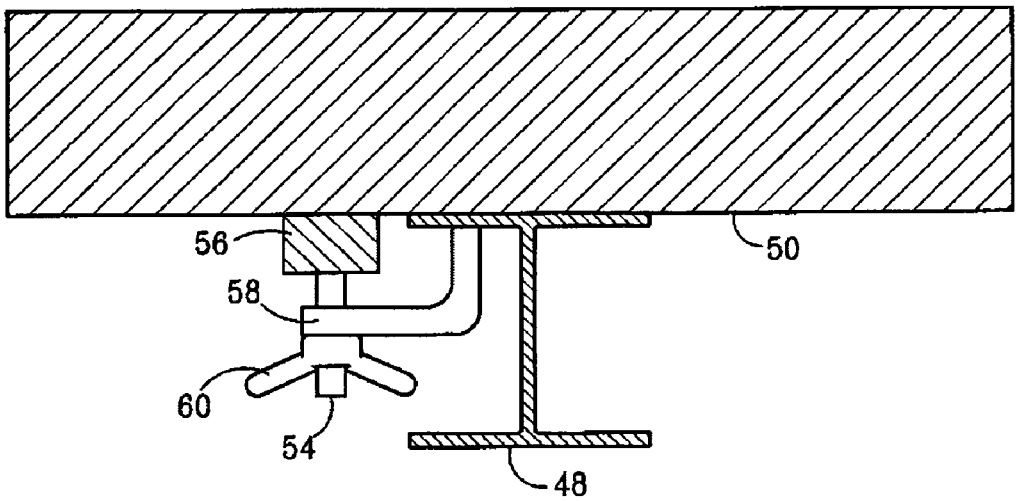
FIG. 9B

SYSTEMS AND PROCESSES FOR COVERING OPENINGS OF MARINE VESSEL HULLS

BACKGROUND INFORMATION

This disclosure relates generally to systems and processes useful for facilitating repair and maintenance of sea valves and other components on marine vessels, particularly large vessels, including vessels used for floating storage (FSO's) and production (FPSO's), while in the water. Specifically, the systems and processes described herein relate to facilitating repairs and maintenance of sea valves, and other components, on marine vessels by closing openings in the hulls of marine vessels to permit dry access to the sea valves and other components which are normally in direct communication with the openings.

Many large marine vessels, such as sea going ships, FSO's and FPSO's and the like, have openings in the hull below the waterline to allow inflow and outflow of water into cavities often referred to as sea chests. A sea chest is simply a cavity or chamber behind the hull of a marine vessel below the waterline that communicates externally with the water. The sea chest is often connected by plumbing such as piping and valves to convey water for various purposes within the ship. Such openings to the water are used for many purposes including drawing of water from the ocean for cooling and the like and for expelling water and other waste material into the ocean. The openings are typically connected by conduits and the like to pumps, valves, and other equipment within the engine room and other compartments of the vessel.

It is necessary to inspect piping and valves, and on occasion to replace or repair some of the plumbing or valves in and around the openings and leading to the openings. These repairs and reconstructions can be readily accomplished in dry dock. However, dry docks are frequently unavailable or are available only after a long wait. Moreover, putting a marine vessel in dry dock to perform such repairs and maintenance takes the vessel out of service, which usually results in substantial adverse financial affects.

Some sea chests require an affixed cover that may be opened and closed as needed while the vessel is in service. For example, many ships utilize maneuvering thrusters within sea chests from which water is ejected through hinged covers that act as a cover that opens to permit water to exit and closes to prevent water from entering the sea chest. Other sea chests do not have fixed covers and temporary covers are used to close the opening in the marine vessel hull to the sea chest when it becomes necessary to have dry access to the sea chest compartment while the vessel is in the water. Vessels with temporary covers require divers to properly place the covers over openings. This can be a hazardous operation, particularly in areas where there is restricted visibility.

U.S. Pat. No. 5,692,451 discloses sea chest covers fabricated from one or more viscoelastic materials such as polyethylene or polyurethane. The patent discloses that the visoelastic materials reduce corrosion and erosion as well as minimize marine organism growth and ice build-up on the covers. The covers disclosed in this patent are designed to be permanently affixed to a vessel.

U.S. Patent application 2004/0011265 A1 discloses sea chest covers made from viscoelastic materials that have been exposed to gamma radiation for enhanced strength. The application also discloses that the viscoelastic materials may also contain an anti-bacterial or anti algae growth additive. The covers disclosed in this patent are designed to be permanently affixed to a vessel.

U.S. Pat. No. 4,175,510 discloses a cofferdam for closing openings in hulls of vessels below the waterline. The cofferdam is a wooden structure that is lowered by a crane and guided in place by divers. The cofferdam may be secured to the hull of the vessel through attachment to a grating in the opening in the hull with a series of J-bolts.

BRIEF DESCRIPTION OF THE DISCLOSURE

The disclosure relates to systems and processes for closing openings in the hull of a marine vessel. The process and systems are useful for facilitating repair and maintenance of marine vessels, particularly large ocean going and other vessels, such as FSO's and FPSO's, while in the water. Specifically, the systems and processes described herein relate to facilitating repairs and maintenance of such marine vessels by closing openings in the hulls of marine vessels to permit dry access to compartments in communication with the openings.

The processes and systems incorporate a cover constructed from a relatively lightweight material such as fiberglass, or from one or more viscoelastic materials such as polyethylene or polyurethane. The cover is configured to the size and shape necessary to cover the opening in the marine vessel hull to be closed. The cover is guided in place to effectuate closure of the opening by a track device that receives at least two of the peripheral edges of the cover and directs the cover to the proper position to completely cover and close the hull opening.

The cover may be lowered into place by use of a hoisting device such as a davit on a dock, the deck of the vessel undergoing repair or maintenance, or on the deck of another vessel alongside the vessel undergoing repair or maintenance.

The cover may incorporate a number of features to facilitate its proper placement and sealing function. For example, the cover may be provided with a buoyancy control compartment to regulate buoyancy or ballast plates that may be changed to control the weight of the cover and to help maintain the proper orientation of the cover during installation under a variety of sea conditions. The cover may also be provided with a seal layer or annular seal on its surface to enhance the seal between the cover and the hull.

BRIEF DESCRIPTION OF THE DRAWINGS

FIG. 3 is side view of the embodiment of the systems for closing the opening in the hull of a marine vessel depicted in FIG. 1.

FIG. 4 depicts the second surface of a cover of the systems and processes for closing the opening in the hull of a marine vessel in accordance with one embodiment.

FIG. 5 is a side view of the cover 20 depicted in FIG. 3.

FIG. 6 depicts the first surface of an embodiment of a cover of the systems and processes for closing the opening in the hull of a marine vessel.

FIG. 7 depicts a sea chest cover and a track device in accordance with an embodiment of the systems and processes described herein.

FIG. 8 provides a detailed depiction of the interaction of a track device and a sea chest cover in accordance with an embodiment of the systems and processes described herein.

FIG. 9A provides a depiction of an embodiment of a portable track device and means for securing a track device to a vessel hull.

FIG. 9B provides a detailed depiction of an embodiment of a means for securing a track device to a vessel hull.

DETAILED DESCRIPTION

Figure 1:
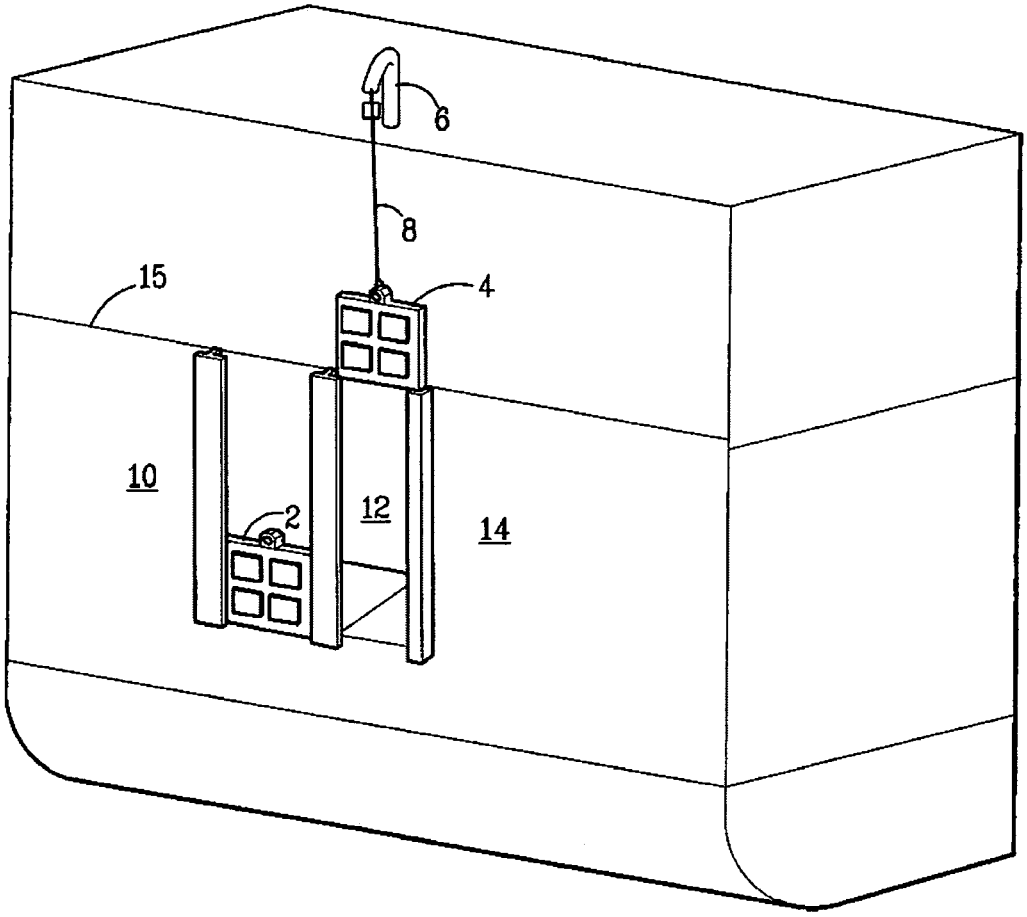
FIG. 1 depicts an embodiment of the systems and processes for closing the opening in the hull of a marine vessel in use on the hull of a marine vessel.

Repair and maintenance operations of marine vessels, particularly FSO's and FPSO's, in dry dock are usually very time consuming and expensive processes. Moreover, the vessel is out of service during the time required to transit from its service location to dry dock facility, the time it takes to conduct the repair or maintenance work, and the time required to transit back to its service location. For FSO's and FPSO's the vessels may require towing by tugboats from location to the shipyard, further complicating transfer to a dry dock. Waiting for dry dock space in busy port may lengthen the service interruption. Of course, the longer the service interruption, the greater the adverse financial impact of the out of service time.

Marine vessels such as floating oil and gas production vessels and petroleum product storage vessels are designed to stay on station in an anchored or moored position for 10 to 30 years. For these types of vessels, dry dock repair and maintenance is completely inconsistent with the intended service lives and economic return for the vessels.

The disclosure relates to systems and processes for closing the opening in the hull of a marine vessel. The process and systems are useful for facilitating repair and maintenance of marine vessels, particularly floating oil and gas production vessels and petroleum product storage vessels. Specifically, the systems and processes described herein facilitate repairs and maintenance of marine vessels by closing openings in the hulls of marine vessels to permit dry access to compartments in communication with the openings without the need to put the vessel in dry dock. By eliminating the need for dry dock to accomplish certain repairs and maintenance, the systems and processes described herein are capable of providing vessel owners and operators significant financial advantages.

The processes and systems described herein incorporate a cover that may be in the form of a panel or plate-like structure constructed from a relatively lightweight material such as fiberglass, or from one or more viscoelastic materials such as polyethylene or polyurethane. The cover is configured in a size and shape as necessary to completely cover the opening in the marine vessel hull opening to be closed. The cover is guided in place to effectuate closure of the opening by a track device having at least two tracks that receive at least two peripheral edges of the cover to direct the cover to the proper position to completely cover the hull opening. The cover may be lowered into place by use of a hoisting device such as a davit on a dock, the deck of the vessel undergoing repair or maintenance, or on the deck of another vessel alongside the vessel undergoing repair or maintenance.

Because of the track device used to guide the cover into position to close the opening of the marine vessel hull, the need for divers to position or place the cover into operation is eliminated or at least minimized. Diver placed covers are very functional in locations were the water is clear and warm and currents are minimal. However, in the many locations around the world where the water is murky, cold, or where strong currents exist, positioning a sea chest cover on a marine vessel is often associated with risk of the health and safety of the divers involved.

FIG. 1 depicts an embodiment of the systems and processes for closing the opening in the hull of a marine vessel in use on the hull of a marine vessel. In this embodiment, two hull opening covers designated 2 and 4 are depicted. The covers are lowered to their functional positions by a marine davit 6 and cable 8 releasably attached to the covers 2 and 4. The covers are guided into place through the use of a track device, which in this embodiment is comprised of three standards 10, 12, and 14. The standards are attached to the hull of the vessel and each standard incorporates a track configured to receive a peripheral edge of at least one of the covers 2 and 4. In the embodiment depicted, standard 12 includes a track on each of its opposite sides. A first track is configured to receive and guide a peripheral edge of cover 2 and a second track is configured to receive and guide a peripheral edge of cover 4. Standards 10 and 14 incorporate tracks configured to receive and guide a peripheral edge of covers 2 and 4, respectively.

The placement of the track standards in accordance with this disclosure is, of course, determined by the location of the opening to be closed by positioning of the covers guided by the tracks. At least two tracks for each cover guide the cover into place in accordance with this disclosure are provided. In one embodiment, the track device includes two tracks, one track is positioned on each side of the hull opening to be closed. It is understood that more than two tracks may be employed in the track device for interaction with a given cover. For example, with reference to FIG. 1, one or more tracks that are not shown may be positioned perpendicular to standards 10, 12, and 14 at the lower terminus of these standards. The perpendicular tracks may be configured to receive the lower peripheral edges of covers 2 and 4.

Placement of the upper terminus of the track standards may vary. In one embodiment, the upper ends of the tracks are positioned at about 50 centimeters below the normal operational waterline 15 of the marine vessel. Placement this close to the surface of the water facilitates guiding the peripheral edges of the covers into the tracks without the assistance of divers. However, it is understood that in many instances some diver assistance may be necessary to position the cover into place to initiate guidance by the track device. However, it is likely that the assistance would be required only at or near the surface of the water, thereby minimizing diver risk.

In one embodiment, an extension to the track could be added to raise the upper start point of the track device above the waterline at the time when the cover is to be put in place over a sea chest opening. Removable tracks may be attached to the vessel hull with studs. Details of an embodiment of such an attachment means will be described hereinafter with reference to portable track devices. If placement of the upper terminus of the track device is below the surface of the water, this also helps protect the tracks from other vessels and debris floating in the water.

The track standards and tracks incorporated therein may be made from a variety of materials, including metals, plastics, fiberglass, viscoelastic materials and other synthetic materials. A variety of lightweight materials are found to be suitable for facilitating construction, installation, and operation. An exemplary material is fiberglass in that it is strong and is impact and corrosion resistant. The track materials may also include additives designed to retard or minimize growth of marine organisms on the tracks. The thickness of the materials used for construction of the tracks may vary with the specific installation requirements and the specific materials used. In one embodiment, the thickness of fiberglass track materials range from about 0.3 cm to about 1.5 cm. In another embodiment, the thickness of the fiberglass is from about 0.6 cm to about 1.2 cm. In a third embodiment, the fiberglass thickness is from about 0.9 cm to about 1.5 cm. In a fourth embodiment, the fiberglass thickness is from about 0.3 cm to about 0.6 cm.

The track standards may be attached to the hull by any suitable means such as waterproof adhesives, stainless steel weld studs, and drilled and tapped doublers.

In other embodiments, the track device may include at least one portable section of track that may be attached to the marine vessel on location when it is needed at that particular point in time. Details of such an embodiment are described hereinafter. Of course, it is understood that the use of a portable track device may lead to problems associated with holding the track device securely in place while in use.

Track devices with tracks for receiving the peripheral edges of the covers in accordance with this disclosure may be of any suitable dimensions and configurations for cooperating with at least two of the peripheral edges of a cover. In one embodiment the tracks may be configured in the shape of grooves for receiving and guiding the peripheral edge of the cover. In other embodiments, the groove of the track may have a tapered configuration to ensure proper positioning of the cover and to retard or minimize growth of marine organisms on the track. For example, the cover may be tapered on the bottom side, along with narrowing the track near the bottom end. The bottom end of the track could then be left "open" so marine growth would not accumulate in the bottom stop.

Figure 2:
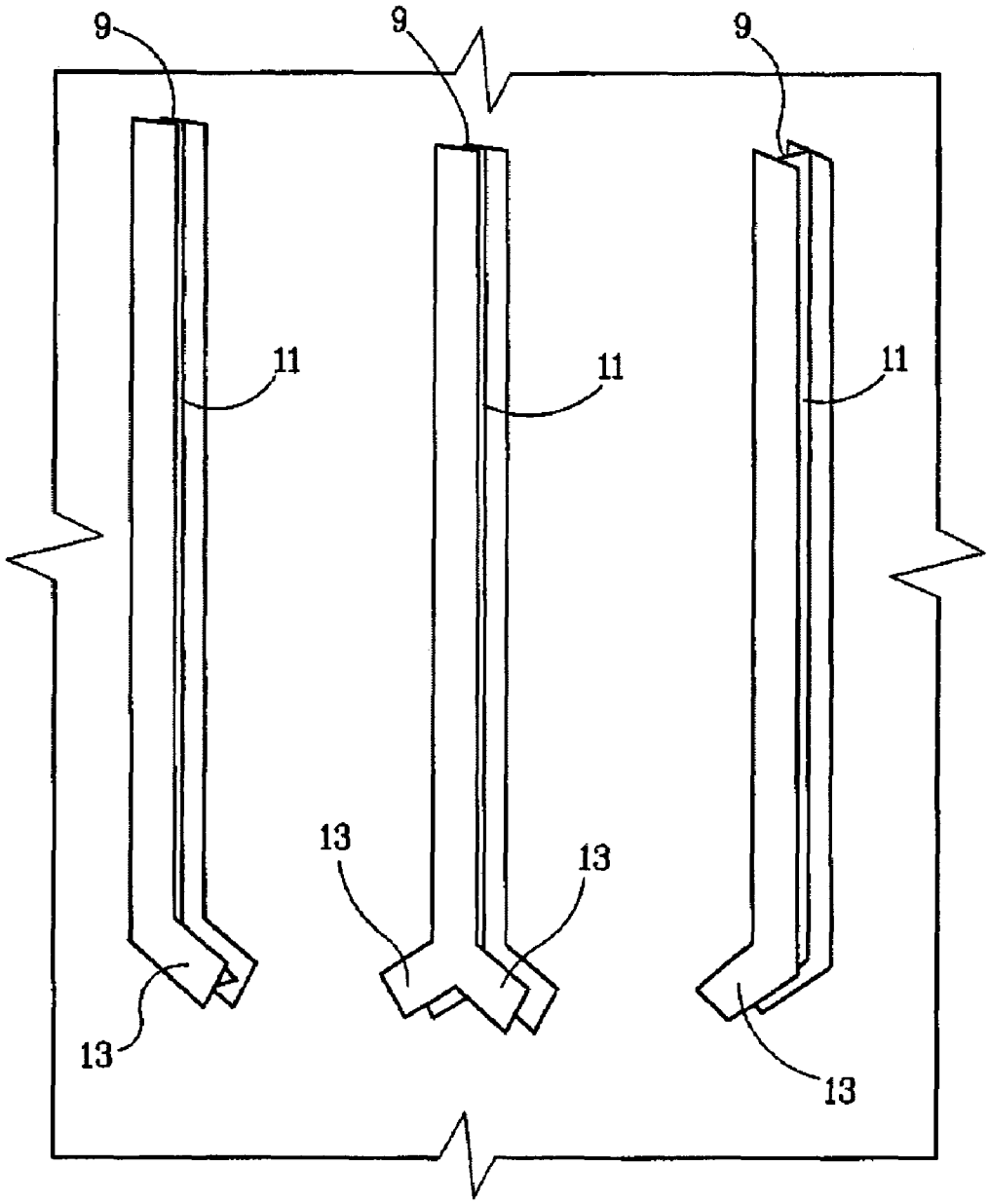
FIG. 2 depicts an embodiment of a track device useful in the systems and processes described herein.

Alternatively, the track devices may have tracks configured as depicted in FIG. 2 wherein the lower portion of the tracks 9 are flared at an angle relative to the main body of the tracks 11 which is linear or substantially linear. As is understood by reference to FIG. 2, the flared portion of the track 13 is configured to receive the lower peripheral edge of the sea cover to hold the lower surface of the sea cover in contact with the hull of the vessel while at the same time providing a stop to hold the sea cover at the proper vertical position along the vessel hull to ensure closure of the sea chest.

FIG. 3 is side view of the embodiment of the systems for closing the opening in the hull of a marine vessel depicted in FIG. 1. The lower peripheral edge of the cover 20 while in use may be at any location along the vessel hull as required by placement of the opening 17 to be closed. However, as may be appreciated, the curvature of the hull is a factor in maintaining contact between the surface of the cover 20 and the hull. In this depiction, the lower peripheral edge of the cover 20 as indicated by the lower terminus of the track 16 is located approximately 200 mm above the bilge radius tangent as indicated by the dimension labeled 18. This dimension should be selected so that the cover 20 and seal is in contact with a flat portion of the hull to assure a proper seal. Positioning the lower peripheral edge of the cover 20 at a position at least 200 mm above the bilge radius tangent ensures maximum functional contact between the cover 20 and the hull. For this reason, in one embodiment, the systems and processes described herein function best when the sea chests bottoms are located above the bilge radius tangent. In other words, the systems and process described herein function best when the sea chest openings are within the "flat" of the vessel's side. In such arrangements, the cover raises and lowers in the track and seals more easily. However, if the cover 20 and track device are sufficiently flexible, the systems and processes described herein are suitable for covering sea chest opening along the curvature of a vessel hull.

The covers used in the systems and process described herein may be of any suitable configuration designed to cover the hull opening to be closed. The covers will have at least three peripheral edges of which at least two are configured for placement into and guidance by at least the tracks into the operative position. However, generally square or rectangular shaped cover configurations are useful for most hull openings. In one embodiment, the cover has a panel or plate-like configuration with first and second surfaces. The first surface is configured for contact with the hull and the second surface is opposite the first surface.

The covers described herein may be constructed from any suitable material. In one embodiment, the covers are made from durable lightweight materials to facilitate handling and long service life. Exemplary suitable cover construction materials are fiberglass, viscoelastic materials such as polyethylene or polyurethane, and blends thereof. The materials used in the covers may also incorporate additives to retard or minimize growth of marine organisms. The construction materials and the covers manufactured form these materials may be a variety of thickness, depending on the desired weight and durability as well as the sea conditions and depths at which the covers will be used. Of course, the covers must be of appropriate thicknesses to allow proper interaction between the cover and the track device receiving the peripheral edges of the cover. In one embodiment, the covers having a thickness of about 5.0 cm to about 20.0 cm. In one embodiment, the covers are in the form of a fiberglass sheet having a thickness of about 5.0 cm to about 20.0 cm. In a second embodiment, the covers are a fiberglass sheet having a thickness of about 10.0 cm to about 15.0 cm. In still another embodiment, the covers are a fiberglass sheet having a thickness of about 15.0 cm to about 20.0 cm. In a fourth embodiment, the covers are a fiberglass sheet having a thickness of about 5.0 cm to about 10.0 cm.

The covers may incorporate a number of features to facilitate their proper placement and sealing function. For example, the covers may be provided with a buoyancy compartment to regulate buoyancy or ballast plates that may be changed to control the weight of the covers and to help maintain proper orientation of the covers during installation under a variety of sea conditions. The covers may also be provided with annular seals or sealant layers to enhance the seal between the covers and vessel hulls.

FIG. 4 depicts exemplary features that may be incorporated into an embodiment of the covers in accordance with this disclosure. When constructed from most of the lightweight durable materials mentioned above, the covers will have slightly negative buoyancy allowing them to be lowered into position using a davit as described above or other similar device. However, as depicted in FIG. 4, the buoyancy of cover 20 may be adjusted through the use of a buoyancy chamber 22 by adding or withdrawing ballast such as water. Additionally, the cover 20 may incorporate solid ballast plates 24 that may be added or removed as necessary for properly controlling buoyancy under certain water conditions. As depicted in FIG. 4, these features are incorporated on the second surface of cover 20 but may be incorporated at other locations on the cover.

FIG. 5 is a side view of cover 20 depicted in FIG. 4. As seen in this view, the buoyancy chamber 22 may incorporate a drain 26 and vent 28 to facilitate entry and exit of water or other ballast from the chamber 22 to regulate buoyancy. Additionally, FIG. 5 depicts a seal 30 that may be provided on the first surface of the cover 20 for contact with the hull to facilitate closure of the marine vessel hull opening. The seal may be made from any suitable material including, but not limited to, natural and synthetic rubber, other synthetic sealing materials, and blends thereof. In one embodiment, the seal is made from synthetic rubber, such as neoprene.

The seal may be configured as a sheet or annulus of seal material to be positioned around the perimeter of the marine vessel hull opening as depicted in FIG. 6. The seal may have a variety of thickness as may be suitable for a particular use application. In one embodiment, the seal material has a thickness of about 0.3 cm to about 1.8 cm. In another embodiment, the thickness is from about 0.6 cm to about 1.2 cm. In a third embodiment, the thickness is from about 1.2 cm to about 1.8 cm. In a fourth embodiment, the thickness is from about 0.3 cm to about 0.6 cm. The seal may be of flat materials forming a layer, or may be of a round or donut shaped cross section to facilitate a tight seal. Depending on seal availability, custom seals or with a "squared 8" configuration may be used. Density of the seal must be sufficient to assure durability, while remaining flexible enough to allow the seal to deform to the imperfections in the hull and to form a tight gasket. Because the gasket relies on the seawater head pressure to press the cover against the hull, the seal itself is not required to adhere directly to the hull.

FIG. 6 also depicts another feature that may be incorporated into the design of the cover 20. A lifting eye 32 may be incorporated onto the top peripheral edge of the cover 20. The lifting eye may be used as a means of attaching the cover 20 to the device used to lower the cover 20 to its operational position or to raise the cover 20 once its function is no longer necessary.

FIG. 7 proves a detailed depiction of the cooperative relationship of a sea chest cover and a track device in accordance with one of the embodiments described herein. Specifically, FIG. 7 depicts a sea chest cover 34 being lowered into a cooperative relationship with tracks 36 and 38 of a track device.

FIG. 8 provides additional detail of a cooperative relationship of a sea chest cover and a track device of one embodiment in accordance with the systems and processes described herein. FIG. 8 also depicts a cooperative relationship of a seal for a sea chest cover and a vessel hull in accordance with an embodiment of the systems and processes described herein. A peripheral edge of a sea chest cover 40 fits within and is guided into place and held in place by a track 42 of a track device. The sea chest cover 40 is provided with a seal 44 that, when the sea chest cover is held in its functional position by track 42, is in contact with the vessel hull 46. The contact between the seal 44 and the vessel hull 46 facilitates a watertight closure of the sea chest using sea chest cover 40.

FIG. 9A and FIG. 9B depict embodiments of a portable track device and means for securing track devices to a vessel hull. The embodiments depicted are useful for securing portable track devices and portions of portable track devices, such as track extensions as previously described. With reference to FIG. 9A, a track 48 is secured to vessel hull 50 by a securing means 52. It is understood that any number of securing means 52 may be used as may be desirable depending on the size and configuration of the track 48.

FIG. 9B provides a detailed depiction of the securing means 52 depicted in FIG. 9A. Track 48 is secured to hull 50 by a securing means including a stud 54 in communication with a doubler pad 56 adjacent to hull 50. A dog or bracket 58 holds the track 48 in position against the hull 50 through the application of force by tightening wing nut 60.

Once a cover is guided into place by a track device as described herein, the sea chest associated with the vessel hull opening being closed may be pumped out or drained. Once water is removed from the sea chest, the water pressure against the second surface of the cover will exceed the atmospheric pressure within the sea chest. This pressure differential will force the cover, and a seal, if used, into engagement with the hull thereby sealing the sea chest and permitting it to be pumped or drained completely and forming a dry work area within the sea chest.

The systems and processes describe herein permit the ready and rapid repair of marine vessels without the necessity of interrupting their surface as required for dry dock repair and maintenance.

All patents and publications referred to herein are hereby incorporated by reference in their entireties.

Although the systems and processes described herein have been described in detail, it should be understood that various changes, substitutions, and alterations could be made without departing from the spirit and scope of the invention as defined by the following claims.

What is claimed is:

1. A marine vessel, comprising:

an underwater opening comprising a sea chest in the marine vessel hull; a single cover corresponding to the underwater opening, the cover having a first and second surface and at least three peripheral edges, wherein the first surface of the cover is provided with a seal configured to releasably seal the underwater opening; and wherein the cover is configured such that the surface area of the first surface of the cover is at least as great as the area of the underwater opening of the marine vessel hull; and wherein the cover is releasably sealable against the hull by reducing a pressure on the first surface of the cover; and at least one track device including at least two tracks having a tapered portion positioned on the marine vessel hull on opposite sides of the opening of the marine vessel hull and wherein the tracks are-configured to receive at least two of the peripheral edges of the cover and to remotely position the cover so that the first surface covers the underwater opening of the marine vessel hull; wherein the tapered portion is positioned on an interior surface of the tracks;

and wherein the tracks are configured in the shape of a groove capable of receiving a peripheral edge of the cover;

and wherein the tracks are comprised of a material selected from the group consisting of fiberglass, a viscoelastic material, and blends thereof having a thickness of about 0.3 cm to about 1.5 cm.

2. The marine vessel of claim 1 wherein the cover is comprised of a material selected from the group consisting of fiberglass, polyethylene, polyurethane, and blends thereof having a thickness of about 5.0 cm to about 20.0 cm.

3. The marine vessel of claim 2 wherein the seal is comprised of a material selected from the group consisting of natural rubber, synthetic rubber, and blends thereof.

4. The marine vessel of claim 3 wherein the cover is provided with a buoyancy chamber capable of controlling the buoyancy of the cover underwater.

5. The marine vessel of claim 4 wherein the cover is provided with an adjustable ballast system capable of varying the weight of the cover.

6. The marine vessel of claim 5 comprising a device for vertically lowering and raising the cover to effect movement of the at least two peripheral edges of the cover along the at least two tracks to cover and uncover the underwater opening of the marine vessel hull.

7. The marine vessel of claim 6 wherein the device for vertically lowering and raising the cover is a davit equipped with a cable.

8. A marine vessel, comprising; an underwater opening comprising a sea chest in the marine vessel hull; a single cover corresponding to the underwater opening and having a first and second surface and at least three peripheral edges wherein the first surface of the cover is provided with a seal configured to releasably seal the underwater opening, and wherein the cover is releasably sealable against the hull by reducing a pressure on the first surface of the cover; and at least one track device including at least two tracks having a tapered portion positioned on the marine vessel hull on opposite sides of the opening of the marine vessel hull and wherein the tracks are configured to receive at least two of the peripheral edges of the cover to remotely position the cover so that the first surface of the cover covers the underwater opening of the marine vessel hull; and wherein the tapered portion is positioned on an interior surface of the tracks;

and wherein the tracks are configured in the shape of a groove capable of receiving a peripheral edge of the cover;

and wherein the tracks are comprised of a material selected from the group consisting of fiberglass, a viscoelastic material, and blends thereof having a thickness of about 0.3 cm to about 1.5 cm.

9. The marine vessel of claim 8 wherein the cover is comprised of a material selected from the group consisting of fiberglass, polyethylene, polyurethane, and blends thereof having a thickness of about 5.0 cm to about 20.0 cm.

10. The marine vessel of claim 9 wherein the seal comprises natural rubber, synthetic sealing materials, and blends thereof.

11. A process for releasably covering an underwater opening in a marine vessel hull comprising:

providing an opening below the waterline in the marine vessel hull, wherein the opening comprises a sea chest; from above the waterline, remotely positioning a cover having a first and second surface and at least three peripheral edges wherein the first surface of the cover is provided with a seal configured for contact with the hull of the marine vessel so that at least two of the peripheral edges are received by and guided along a track device to a position at which the first surface covers the underwater opening of the marine vessel hull; wherein the track device includes at least two tracks having an interior tapered portion positioned on the marine vessel hull on opposite sides of the opening of the marine vessel hull and reducing a pressure on the first surface of the cover sufficient to engage and releasably seal the cover against the hull;

and wherein the tracks are configured in the shape of a groove capable of receiving a peripheral edge of the cover;

and wherein the tracks are comprised of a material selected from the group consisting of fiberglass, a viscoelastic material, and blends thereof having a thickness of about 0.3 cm to about 1.5 cm.

12. The process of claim 11 wherein the cover is comprised of a material selected from the group consisting of fiberglass, polyethylene, polyurethane, and blends thereof having a thickness of about 5.0 cm to about 20.0 cm.

13. The process of claim 12 wherein the seal is comprised a material selected from the group consisting of natural rubber, synthetic sealing materials, and blends thereof.

14. The process of claim 13 wherein the cover is vertically lowered by a davit.

* * * * *